US011135645B2

(12) United States Patent
Rolf

(10) Patent No.: US 11,135,645 B2
(45) Date of Patent: Oct. 5, 2021

(54) MOLD PLATE

(71) Applicant: KME Special Products GmbH, Osnabrück (DE)

(72) Inventor: Thomas Rolf, Osnabrück (DE)

(73) Assignee: KME Special Products GmbH & Co. KG, Osnabrück (DE)

( * ) Notice: Subject to any disclaimer, the term of this patent is extended or adjusted under 35 U.S.C. 154(b) by 0 days.

(21) Appl. No.: 17/052,444

(22) PCT Filed: Aug. 14, 2019

(86) PCT No.: PCT/DE2019/100732

§ 371 (c)(1),
(2) Date: Nov. 2, 2020

(87) PCT Pub. No.: WO2020/064045

PCT Pub. Date: Apr. 2, 2020

(65) Prior Publication Data

US 2021/0162490 A1 Jun. 3, 2021

(30) Foreign Application Priority Data

Sep. 27, 2018 (DE) ..... 10 2018 123 948.3

(51) Int. Cl.
*B22D 11/055* (2006.01)
*B22D 11/04* (2006.01)
*B22D 11/057* (2006.01)

(52) U.S. Cl.
CPC ..... *B22D 11/055* (2013.01); *B22D 11/0408* (2013.01); *B22D 11/057* (2013.01)

(58) Field of Classification Search
CPC ..... B22D 11/055; B22D 11/068; B22D 11/22; B22D 11/225; B22D 11/0408; B22D 11/057; B22D 11/124
See application file for complete search history.

(56) References Cited

U.S. PATENT DOCUMENTS

2008/0073483 A1 3/2008 Streubel et al.

FOREIGN PATENT DOCUMENTS

| | | |
|---|---|---|
| CN | 202353967 U | 7/2012 |
| CN | 203189434 U | 9/2013 |
| CN | 203523189 U | 4/2014 |
| CN | 206061319 U | 3/2017 |
| CN | 207134635 U | 3/2018 |
| CN | 207290829 U | 5/2018 |
| DE | 198 42 674 | 3/2000 |
| DE | 102 37 472 | 2/2004 |

(Continued)

OTHER PUBLICATIONS

International Search Report dated Oct. 9, 2019 by the European Patent Office in International Application PCT/DE2019/100732.

(Continued)

*Primary Examiner* — Kevin P Kerns
*Assistant Examiner* — Steven S Ha
(74) *Attorney, Agent, or Firm* — Henry M. Feiereisen LLC

(57) ABSTRACT

A mold plate has a casting side and a rear side remote from the casting side and includes a cooling channel which is open with respect to the rear side 3 and is arranged in the rear side. An insert is arranged in the cooling channel to reduce a flow cross-section of the cooling channel. The insert is fastened to the mold plate in a pivotally movable manner so that the insert can be pivoted from a closed position into an open position.

14 Claims, 1 Drawing Sheet

(56) References Cited

FOREIGN PATENT DOCUMENTS

| | | | |
|---|---|---|---|
| DE | 102016124801 | | 12/2017 |
| EP | 1 757 385 | | 2/2007 |
| JP | 2006320925 | A | 11/2006 |
| JP | 4808196 | B2 | 11/2011 |

OTHER PUBLICATIONS

Translation of Chinese Search Report dated Jun. 3, 2021 with respect to counterpart Chinese patent application 201980026205.8.

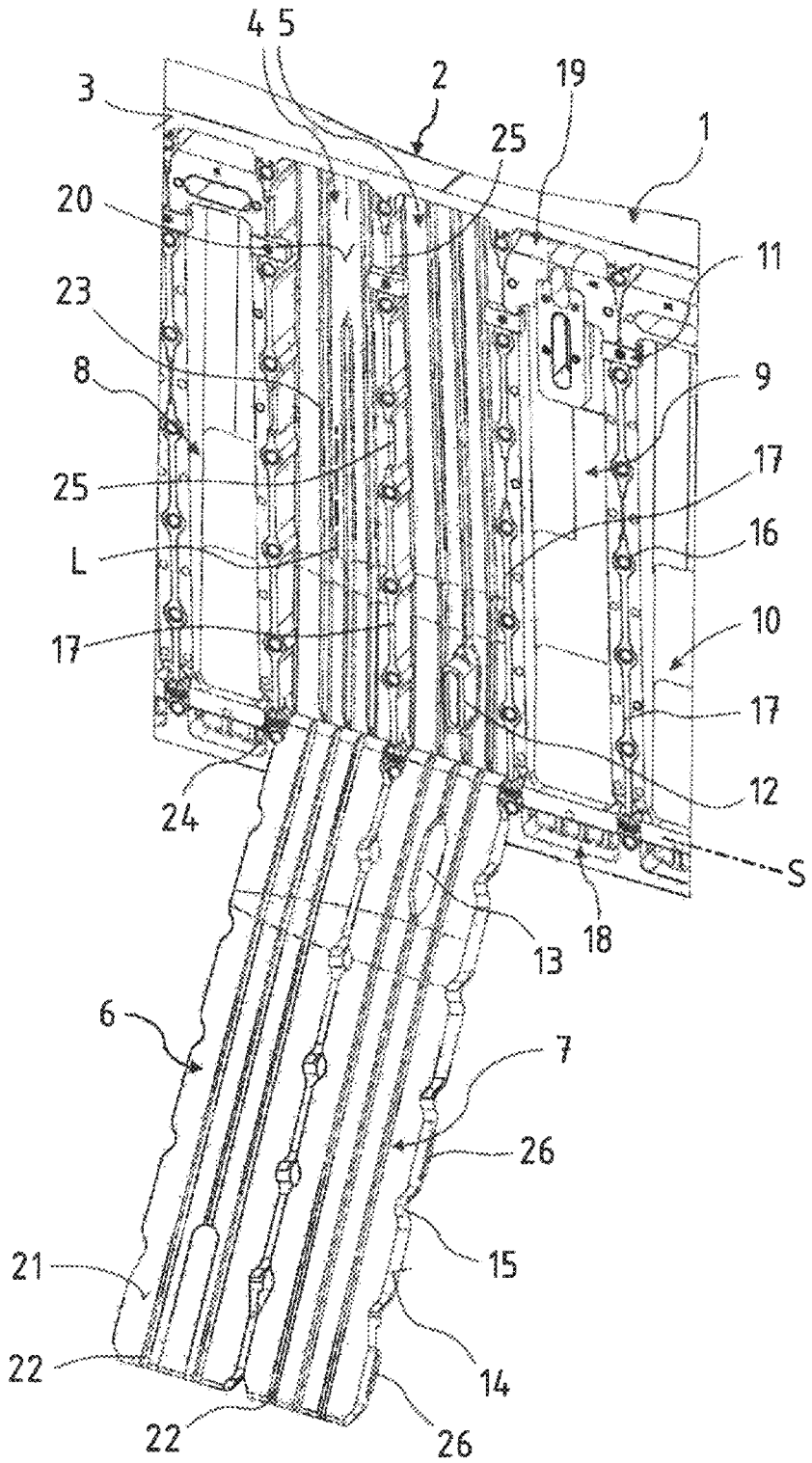
4 5
3
2
19
25
1
20
11
23
8
9
25
17
L
16
17
10
17
24
12
S
18
13
6
7
26
21
15
22
14
22
26

MOLD PLATE

CROSS-REFERENCES TO RELATED APPLICATIONS

This application is the U.S. National Stage of International Application No. PCT/EP2019/100732, filed Aug. 14, 2019, which designated the United States and has been published as International Publication No. WO 2020/064045 A1 and which claims the priority of German Patent Application, Serial No. 10 2018 123 948.3, filed Sep. 27, 2018, pursuant to 35 U.S.C. 119(a)-(d).

BACKGROUND OF THE INVENTION

The invention relates to a mold plate.

A mold for continuous casting, such as continuous thin slab casters, for example, possesses water-cooled mold plates. The mold plates are made from particularly conductive copper alloys. In continuous casting, considerable thermal loads occur within the mold plates. Within a few tenths of a second, the cooling water heats up to such an extent that the cooling water can only be prevented from boiling in some regions by high water pressure. Owing to the warm cooling water and the high water quantity, limescale and other constituents dissolved in the cooling water deposit on the cooling-plate wall to be cooled. These deposits have an insulating effect and have a negative influence on the heat dissipation from the mold plate. Even with thin deposits, the temperature of the mold plate can increase in the affected region, which can lead to softening of the copper material. With regular checks and cleaning cycles, the deposits can be kept low and removed if required. The cleaning cycles involve dismantling the mold plate for the cooling surface of the mold plate to actually be reached.

In mold plates with cooling bores, the plugs with which the bores are closed must be removed for cleaning purposes. The exposed bores are flushed with acid. Afterwards, all plugs must be installed again and the mold plate must be checked for leak-tightness. In mold plates with cooling channels which are open rearwards, insert parts are often present to reduce the local cross-section of the cooling channel. These insert parts must be unscrewed and removed individually for cleaning purposes. This is not only linked to significant time expenditure. There is also a risk that parts can be omitted or mixed up during assembly. This can lead to destruction of the mold plate in the casting process.

DE 10 2016 124 801 B3 discloses a mold plate which has a plurality of fastening points on its rear side for fastening purposes. The mold plate possesses rear-side inserts, which are arranged in cooling channels. The inserts are supported on webs and extent to the height of the rear side. The flow rate within adjacent cooling slots is increased significantly as a result of the inserts. The inserts are held on the rear side via screw connections and in some cases via clamps.

DE 198 42 674 A1 discloses a mold wall of a continuous casting mold. An inner mold plate possesses, on its side facing the water tank, webs having grooves extending between them, in which filler pieces are arranged. To fasten the mold plate to the water tank, it is provided that the grooves have undercuts, that the filler pieces have connecting elements, that the filler pieces engage in the undercuts in a releasable manner and that the screw connections are arranged between the filler pieces and the water tank.

EP 1 757 385 A2 discloses a mold broadside of a funnel mold having at least one groove-shaped cooling channel in the rear side of the broadside. In addition to the cooling channel, recesses are provided on the rear side of the mold broadside, and filler pieces for at least partially closing the recesses. In terms of their extent in the longitudinal direction of the cooling channel, the recesses are restricted to a segment of the cooling channel. In this direction, they have a rectangular and/or wedge-shaped cross-section. As a result, the depth of the cooling channel in the mold broadside should vary in a stepped and/or linear manner in the region of the crossing recesses and be filled with corresponding filler pieces.

DE 102 37 472 A1 discloses a liquid-cooled mold for continuous casting of metals, in which the mold plates are connected to an adapter plate or a water tank by means of fastening bolts. The fastening bolts are fastened to plateau bases protruding, island-like, from the coolant side of the mold plate, which project at least partially into a coolant gap formed between the mold plate or adapter plate and the water tank and possess a streamlined form adapted to the flow direction of the coolant.

The invention is based on the object of demonstrating a mold plate which possesses, on its rear side, cooling channels which are open with respect to the rear side and have inserts, wherein maintenance work in the region of the inserts is facilitated.

SUMMARY OF THE INVENTION

This object is achieved in a mold plate as set forth hereinafter.

The subclaims relate to advantageous further developments of the invention.

The mold plate according to the invention possesses a casting side and a rear side remote from the casting side. At least one cooling channel, which is open with respect to the rear side, is located in the rear side. An insert is arranged in the cooling channel to reduce the flow cross-section of the cooling channel and to increase the flow rate of the cooling water. The flow cross-section is not blocked completely, but reduced to the extent that an inflow opening and an outflow opening adjacent to the inserts remain clear and furthermore to the extent that the desired cooling gap for cooling water to flow through is available between the inflow opening and the outflow opening.

It is provided in the invention that the insert is fastened to the mold plate in a pivotally movable manner.

Fastening the at least one insert in a pivotally movable manner has the advantage that the insert can be swung open for inspection, maintenance and cleaning purposes. On the one hand, this enables unhindered access to the cooling side of the mold plate. At the same time, by swinging open the inserts, the inner side of the inserts is visible and accessible and can likewise be easily cleaned. A further advantage is that the pivotally movable inserts essentially remain on the mold plate. They cannot go missing. This is an essential safety advantage since installation errors when assembling the mold plate can be eliminated.

The mold plate according to the invention preferably possesses a plurality of cooling channels, and accordingly a plurality of inserts. The mold plate, for example for continuous thin slab casting, is arranged substantially vertically in the fitted position-owing to the gravity of the melt. The cooling channels extend preferably parallel to the casting direction, i.e. from the upper end of the mold plate to the lower end of the mold plate. It is regarded as particularly advantageous if the pivot axis of the insert is perpendicular to the longitudinal axis of the at least one cooling channel. As a result, the insert can be pivoted into the cooling channel in the longitudinal direction. This simplifies handling. Since the cooling channels are generally substantially longer than they are wide, the pivot axis can therefore be relatively short.

The pivot axis is located in particular at a lower end of the mold plate. As a result of an, in particular, horizontal pivot axis at the lower end, the insert can be swung downwards from a closed position into an open position. Gravity holds the insert automatically in the open position. It is not necessary to support the insert, as would be necessary with a pivot axis at the upper side or with a pivot axis orientated in another manner. For cleaning purposes, the mold plate with the inserts stands before the technician like an open book whereof the pages or inserts are swung downwards. The inserts can preferably be pivoted to the extent that they can be pivoted beyond 90° from the closed position into the open position. As a result, the inserts can then also be held in the open position if the mold is laid down horizontally, for example.

With a plurality of cooling channels, a plurality of pivotable inserts are preferably also provided. The pivot axes of all inserts are preferably located in a common axis and, in particular, at the lower end of the mold plate.

Securing means are preferably arranged on the rear side so that the inserts are held in the closed position when the mold plate is installed in the water tank again. These securing means can be screwed on. They can refer to a crossbar, for example, which has a fastening portion for fastening to the mold plate and a securing projection which reaches over a rear side of the insert in the closed position. Such a securing means can also have a plurality of securing projections and thereby simultaneously lock a plurality of mutually adjacent inserts in the closed position. A respective securing means is preferably located between two adjacent inserts. Two securing means, one on the left side and one on the right side, are preferably associated with each insert. Where possible, these securing means are located at a large spacing from the pivot axis so that the securing means do not have to absorb large forces to hold the respective insert in the closed position.

The insert possesses an inner side, which faces the mold plate in the closed position. This inner side is opposite a cooling surface of the cooling channel. The cooling surface is the opposite surface to the casting side of the mold plate. A cooling gap between the cooling surface and the inner surface is formed by the insert. The insert, by means of its inner side, can be in partial contact with the cooling surface. The contact can be produced by projections on the insert on the one hand or by projections on the cooling surface on the other. Since the contact regions are provided to create barriers for the cooling water so that mutually separate cooling gaps are produced, the contact regions effectively act as a seal. Webs on the cooling side of the mold plate can increase the rigidity of the mold plate. Tongue and groove configurations can therefore also be produced in the contact region. To this end, the insert, on its inner side, can have grooves in which webs of the mold plate are accommodated in the closed position so that, between the adjacent webs, the desired cooling gap is produced between the insert and the mold plate. Each insert can have a plurality of contact regions or a plurality of grooves or, inversely, also a plurality of webs which, in this case, are accommodated in grooves of the mold plate.

The division of the insert into a plurality of cooling gaps which are formed by a single insert enables the number of inserts mounted in a pivotally movable manner to be reduced. For example, a single insert can have three grooves so that four cooling channels are formed adjacent to the three grooves or webs of the mold plate.

Owing to its size, the insert can also be referred to as an insert block and simultaneously spans a plurality of cooling gaps within a single cooling channel. Such an insert block requires only a single pivotable connection. The complete insert block is, in particular, releasably coupled to the rear side. The insert is therefore removable. Following wear on the mold plate, it can be used again with a new mold plate.

The connection between the mold plate and the insert should not necessarily be released for regular maintenance work. It is possible to release the pivotal connection when necessary. To this end, a connecting element can be arranged between the insert and the rear side. This can be a pivot pin which is mounted in the rear side. The connecting element can also be a hinge which is connected to the insert and the mold plate on the rear side. The connecting element ensures that the insert can be displaced from an open position into a closed position as a result of a guided movement. At the same time, positioning problems are thereby prevented. Moreover, it is possible to directly ascertain by purely visual means if an insert is not present in a cooling channel. The reliability during installation is substantially greater.

The insert is adapted in terms of its contour to the properties on the cooling side of the mold plate. In particular, it is configured to be substantially rectangular in terms of its basic shape. It can moreover have an opening for a projection arranged in the cooling channel, wherein this projection is accommodated in the opening in the closed position of the insert. Such an opening can be a particular bearing point, such as a fastening base, for example. The mold plate can be connected directly to a supporting plate via the fastening base.

The fastening points of the mold plate are located between adjacent inserts. Fastening points which follow one another in the casting direction can be connected to one another via webs. The series of fastening points and webs separate the individual cooling channels from one another. The webs between the fastening points are, at the same time, the lateral delimitations for the inserts. Each insert is preferably located between two such webs.

The webs can essentially be narrower than the fastening points. The insert can therefore be contoured in its longitudinal extent so as to produce a constant gap width from the webs or the fastening points. Owing to the preferably multiple fastening points, the insert can have an indentation for each fastening point on its longitudinal side.

In the mold plate according to the invention, a water inlet and a water outlet are preferably located adjacent to a lower end and upper end of the insert respectively.

Considerably easier maintenance of a mold plate is possible by means of the invention. The only region which is possibly less readily accessible as a result of the connection between the insert and the mold plate is the region below the hinge. However, this small surface is negligible given the size of the mold plates. The advantages of the improved accessibility far outweigh this. The cleaning and installation work can be carried out substantially more quickly and the mold plate can be back in service sooner.

BRIEF DESCRIPTION OF THE DRAWINGS

The invention is explained in more detail below with reference to an exemplary embodiment illustrated in a schematic drawing, which shows by way of sole FIG. 1 a perspective illustration of a mold plate according to the present invention.

DETAILED DESCRIPTION OF THE PREFERRED EMBODIMENTS

FIG. 1 shows a perspective illustration of a mold plate 1 in a partial section. The rear side 3 of the mold plate 1 is illustrated, wherein, of this rear side 3, again only a partial region of the mold plate 1 is shown. The mold plate 1 possesses a casting side 2, which is opposite the rear side 3. The casting side 2 is contoured in the illustrated region, and is specifically provided with a concave indentation. The rear side 3 is fastened to a supporting plate (not illustrated in more detail).

The rear side 3 of the mold plate 1 is cooled. To this end, cooling channels 4, 5 are located in the rear side 3. The cooling channels 4, 5 extend in the casting direction, i.e. from top to bottom in the plane of the drawing. The two central cooling channels 4, 5 are open. In the lower region of FIG. 1, two inserts 6, 7 can be seen. These two inserts 6, 7 are pivotable about a pivot axis S. The pivot axis S of the two inserts 6, 7 is perpendicular to the longitudinal direction L of the cooling channels 4, 5. In other words, the inserts 6, 7 can be pivoted downwards from a closed position into the illustrated open position. Gravity holds the two inserts 6, 7 in the open position. The two inserts 6, 7 can be displaced independently of one another into the closed position again, in that they are pivoted upwards in the plane of the drawing. They are then located in the respective cooling channel 4, 5. In the illustration of FIG. 1, three further inserts 8, 9, 10 are illustrated, which are located in the closed position. They terminate with their rear sides flush with the rear side 3 of the mold plate 1. They are likewise pivotable about the pivot axis S at the lower end of the mold plate 1. The inserts 6-10 are secured in the closed position. To this end, securing means 11, which each hold two mutually adjacent inserts 9, 10, are located in the upper fifth of the mold plate 1. The securing means 11 are screwed to the mold plate 1. An insert 6-10 is therefore unable to move from the closed position into the open position on its own.

If the mold plate 1 is in use, the mold plate 1 as a whole is supported on a supporting plate (not illustrated in more detail). The securing means 11 therefore do not serve to absorb the cooling-liquid forces acting on the inserts 6-10, but merely to hold the inserts 6-10 in the closed position.

The cooling channels 4, 5 are configured differently. For example, a projection 12 is located in the lower region in the cooling channel 5. The projection 12 is accommodated in an opening 13 of the insert 7 in the closed position of the insert 7. It can furthermore be seen that the further insert 9, in the closed position, is configured differently from the adjacent insert 10 or the insert 8 at the other end of the mold plate 1. The respective inserts 6-10 are adapted to the local cooling requirements in the respective cooling channel 4, 5. They can be pivoted into the respective cooling channels 4, 5 to fit perfectly. To this end, the inserts 6-10 possess indentations 15 on their longitudinal sides 14, these indentations 15, in the closed position, are located adjacent to fastening points 16 via which the mold plate 1 is connected to the supporting plate (not illustrated in more detail) in the fitted position. A plurality of fastening points 16 follow one another in the casting direction in mutually spaced rows. Webs 17, which extend to the rear side 3 of the mold plate 1, are located between two adjacent fastening points 16. The inserts 6-10 abut with small, edge projections 26 in depressions 25 in the webs 17 of the mold plates 1 so that they cannot fall inwards and reduce/close the cooling gap.

During operation, cooling water can flow into the respective cooling channel 4, 5 via a water inlet 18 and can flow out again via a water outlet 19. In this case, the cooling water flows over a cooling surface 20 of the mold plate 1, wherein the cooling surface 20 is opposite the casting side 2. In the closed position, the cooling surface 20 is opposite an inner side 21 of the respective insert 6-10. The Inner sides 21 in this exemplary embodiment are provided with a plurality of grooves 22 extending mutually parallel and extending at a spacing from one another. The grooves 22 are provided to receive webs 23 which protrude at the cooling surface 20 and face in the direction of the rear side 3. Respective cooling gaps are located between mutually adjacent webs 23 such that they are delimited by the cooling surface 20 and the inner side 21. A plurality of these cooling gaps extend parallel to one another, wherein a high flow rate prevails within the cooing gaps.

In this exemplary embodiment, the inserts 6-10 are connected to the mold plate via a pivot pin (not illustrated in more detail) acting as a connecting element. The inserts 6-10 are captively held. However, the inserts 6-10 are still removable and can be released from the mold plate 1, in particular when the mold plate 1 is worn and the inserts 6-10 enable further use with a new mold plate.

The mold plates according to the invention are, in particular, thin-walled mold plates, which are made from a copper material and can absorb thermal loads of 3-7 MW/qm and, in particular, ca. 5 MW/qm in rated operation. The deposits produced by the cooling water should not exceed a thickness of 0.01 mm, wherein deposits with a thickness of up to 0.5 mm are possible. The mold plate should be freed of deposits having a greater thickness. To this end, the mold plate is removed from the continuous casting mold. After exposing the rear side 3, the securing means 11 are released and the individual inserts 6-10 are pivoted from the closed position into the open position for maintenance and for cleaning. After cleaning, the inserts 6-10 can be pivoted back into the closed position. The securing means 11 are fitted again and the mold plate is ready to be used again.

If the inserts 6-10 need to be removed completely, connecting means 24, which are screwed to the mold plate 1 in the region of the pivot axis S, can be released.

The invention claimed is:

1. A mold plate, comprising:

a casting side;

a rear side remote from the casting side;

a cooling channel arranged in the rear side and open with respect to the rear side; and an insert arranged in the cooling channel to reduce a flow cross-section of the cooling channel, said insert fastened to the mold plate in a pivotally movable manner so as to be able to pivot from a closed position into an open position.

2. The mold plate of claim 1, wherein the insert pivots about a pivot axis which is perpendicular to a longitudinal direction of the cooling channel.

3. The mold plate of claim 1, wherein the insert pivots about a pivot axis which is arranged at a lower end of the mold plate so that the insert is swingable downwards from the closed position into the open position.

4. The mold plate of claim 1, further comprising a securing element arranged on the rear side and configured to hold the insert in the closed position.

5. The mold plate of claim 4, further comprising a plurality of said insert placed in adjacent relationship, said securing element configured to simultaneously lock the plurality of said insert in the closed position.

6. The mold plate of claim 1, wherein the insert has an inner side which, in the closed position, is in partial contact with a casting-side-remote cooling surface of the cooling channel such as to form a cooling gap between the cooling surface and the inner side.

7. The mold plate of claim 1, wherein the insert has an inner side having grooves, and further comprising webs received in the grooves in one-to-one correspondence in the closed position of the insert, so that, between adjacent ones of the webs, a cooling gap is established between the insert and the mold plate.

8. The mold plate of claim 1, wherein the insert is releasably connected to the mold plate.

9. The mold plate of claim 1, further comprising a connecting element arranged between the insert and the mold plate.

10. The mold plate of claim 9, wherein the connecting element is a pivot pin mounted in the mold plate.

11. The mold plate of claim 9, wherein the connecting element is a hinge connected to the insert and the mold plate.

12. The mold plate of claim 1, further comprising a projection arranged in the cooling channel and received in an opening of the insert, when the insert pivots into the closed position.

13. The mold plate of claim 1, further comprising:

a plurality of said insert; and fastening points arranged between adjacent ones of the plurality of said insert.

14. The mold plate of claim 1, wherein the insert has an indentation on a longitudinal side of the insert.

* * * * *